US006978790B2

(12) United States Patent
Byun

(10) Patent No.: US 6,978,790 B2
(45) Date of Patent: Dec. 27, 2005

(54) COSMETICS CONTAINER

(76) Inventor: Young Kwang Byun, MokdongSinsigaji Apt. 928-1005, 312, Shinjung-dong, Yangchun-gu, Seoul (KR)

( * ) Notice: Subject to any disclaimer, the term of this patent is extended or adjusted under 35 U.S.C. 154(b) by 412 days.

(21) Appl. No.: 10/449,142

(22) Filed: May 31, 2003

(65) Prior Publication Data

US 2004/0173234 A1 Sep. 9, 2004

(30) Foreign Application Priority Data

Mar. 3, 2003 (KR) ..... 10-2003-0012974

(51) Int. Cl.[7] ..... A45D 33/20; A45D 33/24; B65D 71/00

(52) U.S. Cl. ..... 132/287; 132/294; 206/851

(58) Field of Search ..... 132/294, 287, 132/313–315, 293; 206/581, 823, 373, 372

(56) References Cited

U.S. PATENT DOCUMENTS 2,547,971 A * 4/1951 Polin et al. ..... 132/297
4,852,727 A * 8/1989 Oberle ..... 206/39.4
6,889,696 B2 * 5/2005 Thorpe et al. ..... 132/287

* cited by examiner

*Primary Examiner*—John J. Wilson
*Assistant Examiner*—Robyn Doan
(74) *Attorney, Agent, or Firm*—Bell, Boyd & Lloyd LLC

(57) ABSTRACT

Disclosed is a cosmetics container comprising a container body adapted to contain cosmetic compositions therein, a lid having a hinge part formed at one side surface thereof for hingeably connecting the lid to the container body and a swab body adapted to act as a cosmetic implement, characterized in that a swab body insertion hole is formed at one side surface of the container body which is opposite to the hinge part of the lid; a lid protrusion part is formed at another side surface of the lid which is opposite to the hinge part of the lid; the swab body comprised a swab part formed at one end thereof for applying cosmetics, a lid contact part formed at the top portion of another end thereof opposite to the swab part and a spring stopper formed at the bottom portion of the another end thereof; and a bottom plate is mounted on the bottom surface of the container body and having a swab body guide groove formed thereon for allowing the swab body to be fixedly inserted thereinto, a spring stopper guide groove formed thereon for allowing the spring stopper of the swab body to be fixedly inserted thereinto and a spring fixture formed thereon for allowing the spring to be fixed thereto.

17 Claims, 17 Drawing Sheets

COSMETICS CONTAINER

BACKGROUND OF THE INVENTION

The present invention relates to a cosmetics container for containing cosmetics. More particularly, the present invention relates to a cosmetics container including a lid for protecting cosmetic compositions.

A cosmetics container has been developed to have various structures according to the properties of cosmetics contained therein. The cosmetics are generally applied to a body part, such as face, to ensure a moisturizing, color-correcting or anti-wrinkle effect. Therefore, such functional or decorative cosmetics made of natural substances or compounds have been prepared and sold by many foremost manufacturers all over the world.

The cosmetics are classified into a liquid-type and a solid-type according to their properties. The solid-type cosmetics are classified cosmetics by pulverized type and an aggregated type. Besides, the liquid-type cosmetics include one that is applied to the skin in an aerosol state by means of a sprayer.

In case of the pulverized type or the aggregated type, a user applies the cosmetics on his or her body part with a powder puff, a swab or a brush. When the powder puff is used, he or she applies the cosmetics to the skin with the powder puff in a patting motion. Meanwhile, when the swab or the brush is used, he or she applies the cosmetics to the skin with the swab or the brush in a dabbing motion.

In the meanwhile, a conventional cosmetics container is of a double structure with a lid and a body. The body has a recess formed therein for containing cosmetic compositions and the swab or the brush for use in applying the cosmetic compositions. When the user wants to use the cosmetics container, he or she opens the lid, and takes the swab or the brush out of the body to hold the same in his or her hand. After that, he or she covers the swab or the brush with the cosmetic compositions contained in the body and then applies the cosmetic compositions to the skin with the swab or the brush in the dabbing motion. The conventional cosmetics container includes a fixing member for hingeably connecting the lid to the body and allowing the lid to be maintained in a closed state when not being used, thereby preventing the lid from being opened unexpectedly. This complicates the structure of the body and marks the external appearance of the cosmetics container.

Further, when the swab or the brush is held in the body together with the cosmetic compositions, since the space for the cosmetic compositions is limited, a larger amount of cosmetic compositions cannot be contained. To contain a predetermined amount of cosmetic compositions, the plane area of the body needs to be expanded and thus the overall dimension of the container is accordingly increased.

SUMMARY OF THE INVENTION

Accordingly, the present invention has been made in view of the above problems, and it is an object of the present invention to provide a cosmetics container, which substantially obviates one or more problems due to limitations and disadvantages of the related art.

Another object of the present invention is to provide a cosmetics container in which a lid is stuck to a container body by means of a cosmetic implement, such as a swab or a brush.

Still another object of the present invention is to provide a cosmetics container in which a lid is stuck to a container body by means of a cosmetic implement so that a container body has an aesthetically pleasing appearance.

Yet another object of the present invention is to provide a cosmetics container in which a cosmetic implement is fixedly held in a container body by means of a lid.

To achieve these objects in an aspect of the present invention, there is provided a cosmetics container comprising a container body adapted to contain cosmetic compositions therein, a lid having a hinge part formed at one side surface thereof for hingeably connecting the lid to the container body and a swab body adapted to act as a cosmetic implement, characterized in that a swab body insertion hole is formed at one side surface of the container body which is opposite to the hinge part of the lid; a lid protrusion part is formed at another side surface of the lid which is opposite to the hinge part of the lid; the swab body comprised a swab part formed at one end thereof for applying cosmetics, a lid contact part formed at the top portion of another end thereof opposite to the swab part and a spring stopper formed at the bottom portion of the another end thereof; a bottom plate is mounted on the bottom surface of the container body and having a swab body guide groove formed thereon for allowing the swab body to be fixedly inserted thereinto, a spring stopper guide groove formed thereon for allowing the spring stopper of the swab body to be fixedly inserted thereinto and a spring fixture formed thereon for allowing the spring to be fixed thereto; and a spring for elastically supporting the swab body is disposed on the bottom plate.

Preferably, the cosmetics container has a cylindrical shape, hexagonal prism shape or polygonal prism shape.

Preferably, the swab body acting as the cosmetic implement is replaced by a brush assembly.

Preferably, the brush assembly includes an assembly case, a brush fixture adapted to allow a plurality of bristles to be fastened thereto and movably formed within the brush case and a brush fixture moving grip integrally formed with the brush fixture in such a manner as to be outwardly protruded through an opening formed at one portion of the brush case.

Preferably, the lid protrusion part of the lid includes a projection integrally formed therewith in such a manner as to be extended inwardly therefrom and perpendicularly thereto, and the swab body or the brush assembly has a recess formed at the outer surface of one end thereof in such a manner as to come in contact with the lid protrusion part of the lid.

Preferably, the cosmetics container further includes an elastic body formed between the outer surface of a cosmetic composition receiving part of the container body and the inner surface of the lid.

Additional features and advantages of the present invention are described in, and will be apparent from, the following Detailed Description of the Invention and the figures.

BRIEF DESCRIPTION OF THE FIGURES

The above and other objects, features and advantages of the present invention will be apparent from the following detailed description of the preferred embodiments of the invention in conjunction with the accompanying drawings, in which.

DETAILED DESCRIPTION OF THE INVENTION

Reference will now be made in detail to preferred embodiments of the present invention, examples of which are illustrated in the accompanying drawings.

Figure 1:
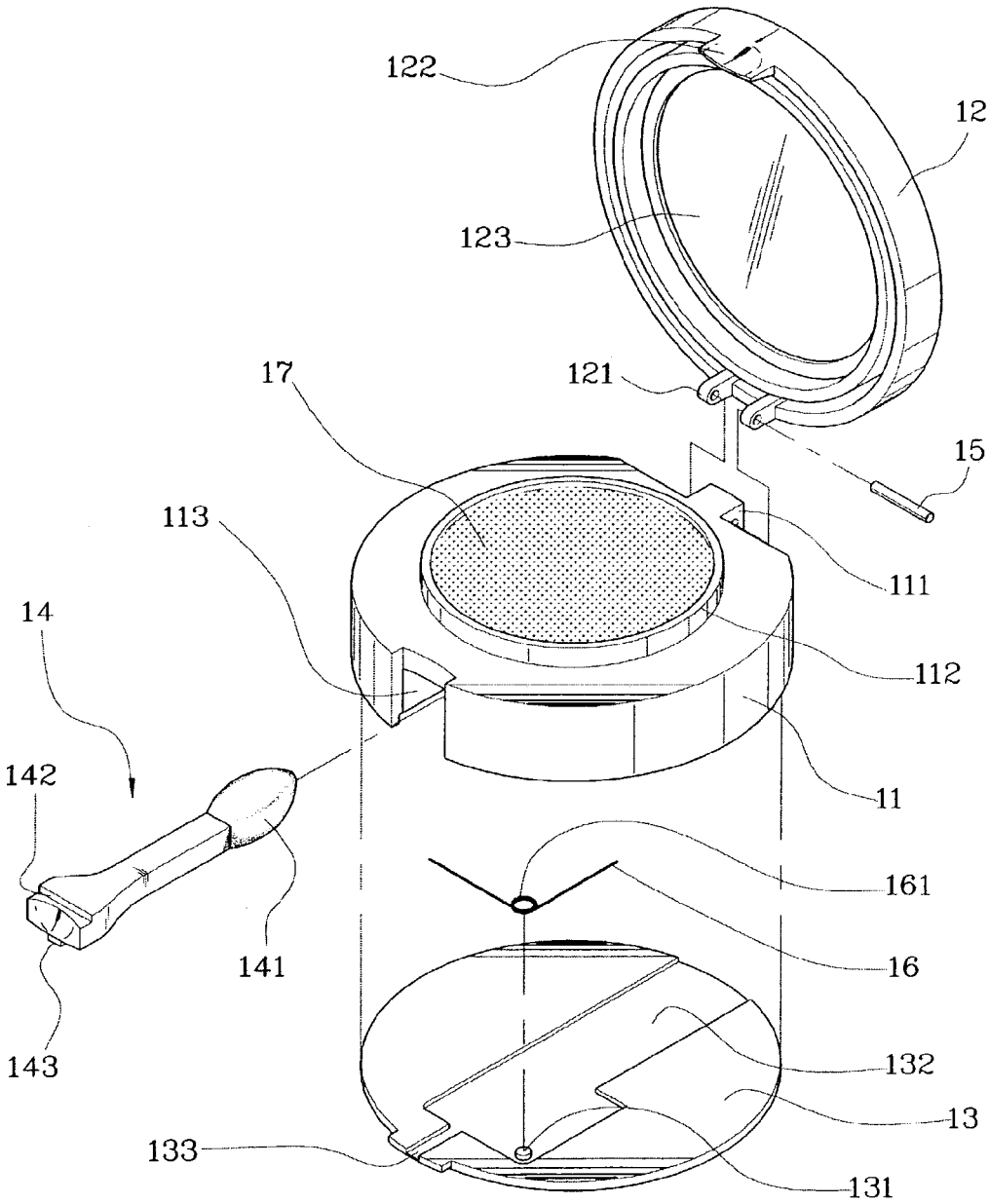
FIG. 1 is an exploded perspective view of a cosmetics container according to a first preferred embodiment of the present invention.
Figure 2:
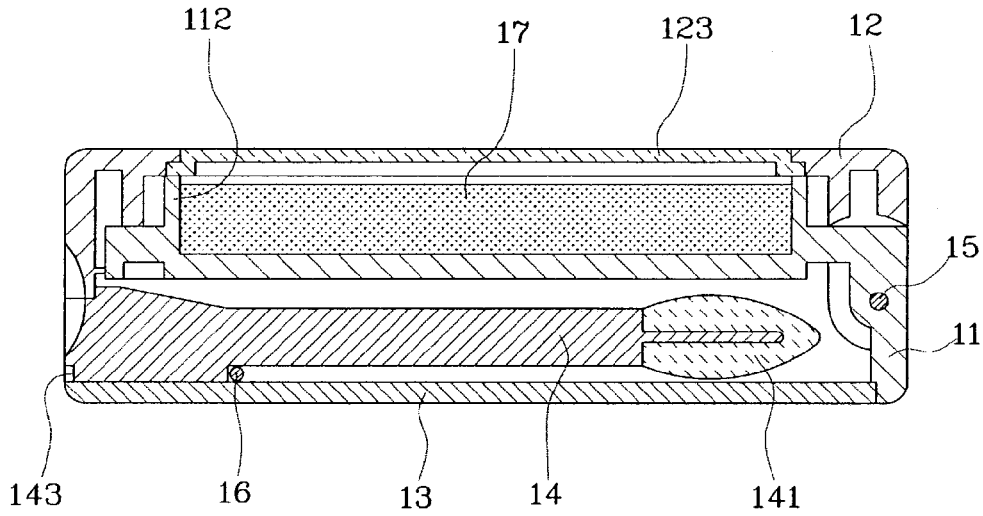
FIG. 2 is a side sectional view illustrating a state in which the cosmetics container of FIG. 1 is closed.
Figure 3:
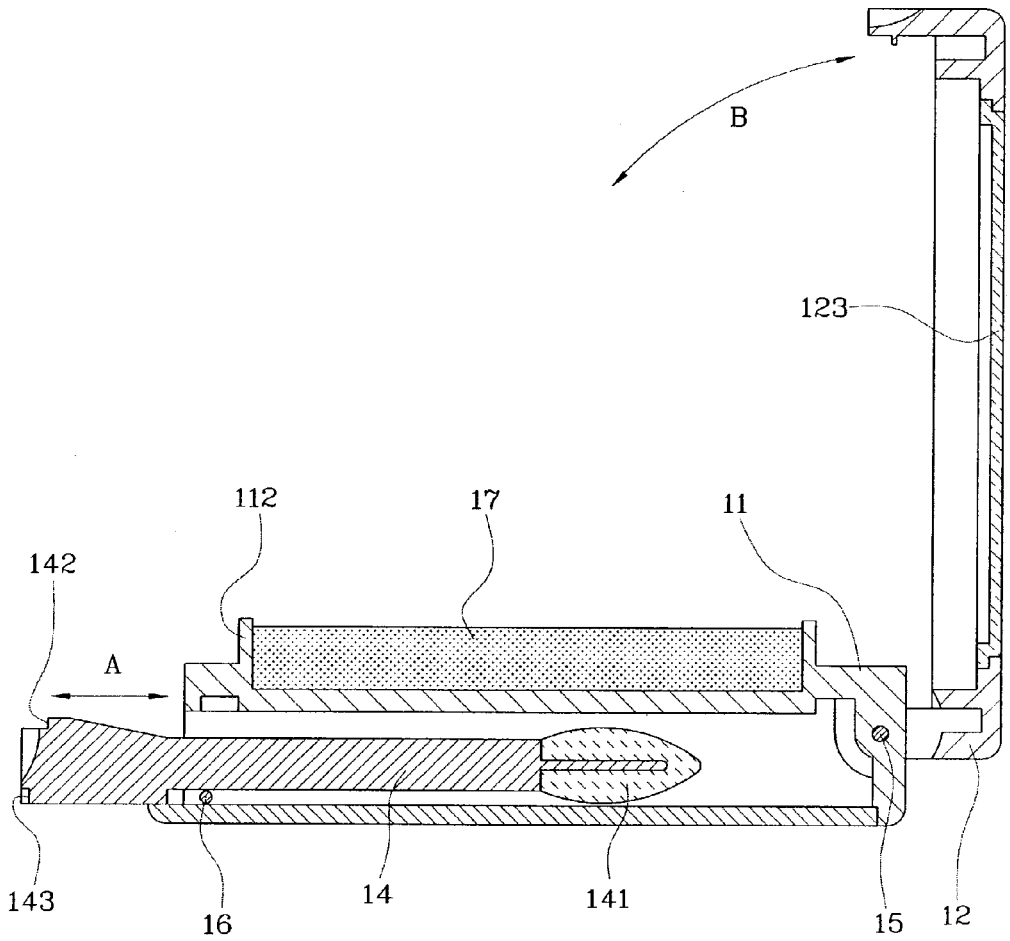
FIG. 3 is a side sectional view illustrating a state in which the cosmetics container of FIG. 1 is opened.
Figure 4:
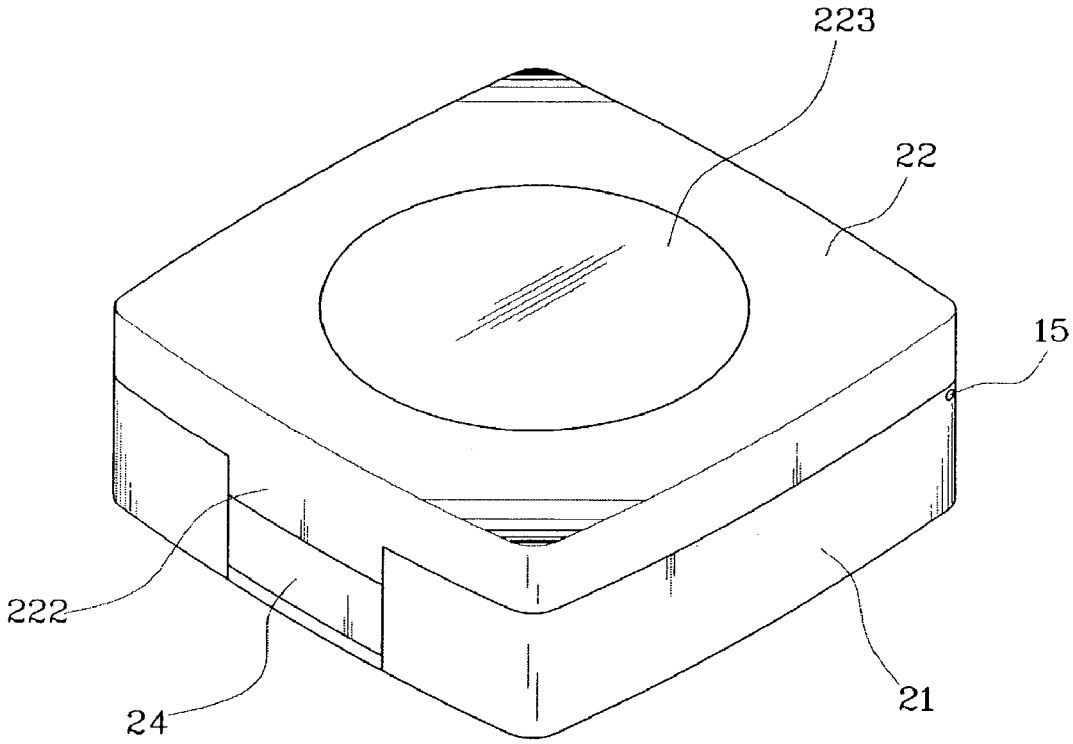
FIG. 4 is a perspective view of a cosmetics container according to a second preferred embodiment of the present invention.

Referring to FIGS. 1 to 3, a cosmetics container comprising a container body 11 adapted to contain cosmetic compositions 17 therein, a lid 12 having a hinge part formed at one side surface thereof for hingeably connecting the lid 12 to the container body 11 and a swab body 14 adapted to act as a cosmetic implement, characterized in that a swab body insertion hole 113 is formed at one side surface of the container body 11 which is opposite to the hinge part of the lid 12; a lid protrusion part 122 is formed at another side surface of the lid 12 which is opposite to the hinge part of the lid 12; the swab body 14 comprised a swab part 141 formed at one end thereof for applying cosmetics, a lid contact part 142 formed at the top portion of another end thereof opposite to the swab part 141 and a spring stopper 143 formed at the bottom portion of the another end thereof; a bottom plate 13 is mounted on the bottom surface of the container body 11 and having a swab body guide groove 132 formed thereon for allowing the swab body 14 to be fixedly inserted thereinto, a spring stopper guide groove 133 formed thereon for allowing the spring stopper 143 of the swab body 14 to be fixedly inserted thereinto and a spring fixture 131 formed thereon for allowing the spring 16 to be fixed thereto; and a spring 16 for elastically supporting the swab body is disposed on the bottom plate 13.

The container body 11 and the lid 12 is hingeably connected to each other in a conventional manner. That is to say, as shown in FIG. 1, a first hinge member 111 formed at one side surface of the container body is coupled to a second hinge member 121 formed at one side surface of the lid 12 in such a manner that a hinge shaft 15 is inserted through a through-hole formed at each of the first hinge member 111 and the second hinge member 121. It will be appreciated to those skilled in the art that the hinging method is not restricted to the above example but other hinging methods can be used.

That is to say, the lid 12 is hingeably connected to the container body 11 such that one end of the cosmetic implement inserted into the container body 11 in such a manner as to be elastically supported by the spring 16 is contacted by the lid protrusion part 122 protruded from the lid 12. Therefore, the lid 12 is not unexpectedly opened due to the friction between the one end of the cosmetic implement and the lid protrusion part 122 while the cosmetic implement is maintained in its state of being inserted into the container body 11 by means of the lid protrusion part 122 of the lid 12.

It is well known that a conventional cosmetics container includes a container body in which cosmetic compositions are contained, a lid hingeably connected to the container body and a swab body which acts as a cosmetic implement. In the conventional cosmetics container, the present invention has an improvement, which includes the container body 11, the lid 12 and the bottom plate 13.

First, the container body 1I has the swab body insertion hole 113 formed at the one side surface thereof opposite to the hinge part. The swab body 14 acting as the cosmetic implement is inserted into the container body 11 through the swab body insertion hole 113.

The bottom plate 13 is fixedly coupled to the bottom surface of the container body 11. The bottom plate 13 has the swab body guide groove 132 formed thereon for allowing the swab body 14 to be fixedly inserted thereinto, the spring stopper guide groove 133 formed thereon for allowing the spring stopper 143 of the swab body 14 to be fixedly inserted thereinto and the spring fixture 131 formed thereon for allowing the spring 16 which elastically supports the swab body 14 to be fixed thereto. The spring 16 has a spring fixing hole 161 in the middle thereof such that the spring fixture 131 is inserted into the spring fixing hole 16 to fix the spring 16 thereto. When the swab body 14 acting as the cosmetic implement is inserted through the swab body insertion hole 113 formed at the one side surface of the container body 11 into a space formed at the time of coupling between the container body 11 and the bottom plate 13 along the swab body guide groove 132 formed at the bottom plate 13. In other words, the swab body 14 is inserted into the predetermined space along the swab body guide groove 132 formed at the bottom plate 13. In addition to the swab body guide groove 132, the spring stopper guide groove 133 is formed at the bottom plate 13 to guide the spring stopper 143 which is formed at the swab body 14. The spring stopper guide groove 133 permits the spring stopper 143 of the swab body 14 to be inserted into a predetermined space. The spring fixture 131 is also formed at the bottom plate 13. The spring 16 is fixed to the spring fixture 131, and located in contact with the spring stopper 143 of the swab body 14 to elastically support the swab body 14.

The lid 12 includes the lid protrusion part 122 formed at the one side surface opposite to the hinge part thereof. Further, the lid 12 may include a transparent pane 123 which allows a view into the container body 11 so that the user can easily know colors of the cosmetic compositions 17 without opening the lid 12. The transparent pane 123 may be materialized of a transparent synthetic resin or the like, which will be easily appreciated to those skilled in the art. The transparent pane 123 is not restricted in shape but can take various shapes including as a circular or quadrangular shape.

The swab body 14 has the swab part 141 formed at the one end thereof for applying cosmetics, the lid contact part 142 formed at the top portion of the another end thereof opposite to the one end thereof and the spring stopper 143 formed at the bottom portion of the another end thereof.

As described above, the bottom plate 13 is mounted to the bottom surface of the container body 111 and the lid 12 is hingeably connected to the container body 11. The spring 16 is fixed to the spring fixture 131 of the bottom plate 13. In the cosmetics container constructed as above, when the swab body 14 is inserted through the swab body insertion hole 113 formed at the one side surface of the container body 11 into the space formed between the container body 11 and the bottom plate 13 due to the coupling between the container body 11 and the bottom plate 13, the swab body 14 is inserted with the swab part 141 thereof facing the swab body insertion hole 113. At this time, the spring stopper 143 formed at the bottom surface of the rear portion of the swab body 14 is caught by one end of the spring 16 fixed to the bottom plate 13. The swab body 14 is entirely inserted into the container body 11 through the swab body insertion hole 113 by continuously pressing the spring 16 to forwardly push the same. After that, the lid 12 is closed to completely cover the container body 11. As shown in FIG. 2, the lid protrusion part 122 formed at the one side surface of the lid 12 is contacted by the lid contact part 142 of the swab body 14. Since an elastic force of the spring 16 is continuously applied to the spring stopper 143 of the swab body 14 in a direction where the swab body 14 is drawn out, the lid contact part 142 of the swab body 14 comes to continuously press the lid protrusion part 122 of the lid 12. As a result, the lid 12 can be maintained in the closed state. Unless the user opens the lid 12, the lid will not be opened unexpectedly.

When the user wants to apply cosmetics, as illustrated in FIG. 3, he or she holds the container body 11 and the lid 12 in his or her hand, and then opens the lid 12 by lifting the lid 12 relative to the container body 11 in an arrow direction B of FIG. 3. As a consequence, the state in which the lid protrusion part 122 of the lid 12 is contacted by the lid contact part 142 of the swab body 14 is released. The swab body 14 received in the container body 11 while being elastically supported by the spring 16 is drawn out from the container body 11 due to the elastic force of the spring 16 in an arrow direction A of FIG. 3. Therefore, the user can easily separate the swab body 14 used as the cosmetic implement from the container body 11 by just lifting the lid 12.

As a consequence, the swab body 14 supports the lid 12 in the state where it is received in the container body 11 so that the lid 12 is prevented from being unexpectedly opened unless an intentional force is exerted thereto. When the user wants to apply cosmetics and thus opens the lid 12, the swab body 14 received in the container body 11 is easily drawn out, thereby achieving convenience in use.

The cosmetics container according to the present invention can take a hexagonal prism shape as shown in FIGS. 4 to 7 as well as a cylindrical shape as described above.

Referring to FIGS. 4 to 7 showing a second preferred embodiment, the cosmetics container comprising a second container body 21 adapted to contain cosmetic compositions therein, a second lid 22 having a hinge part formed at one side surface thereof for hingeably connecting the second lid 22 to the second container body 21 and a brush assembly as a cosmetic implement, characterized in that a swab body insertion hole 113 is formed at one side surface of the second container body 21 which is opposite to the hinge part of the second lid 22; a second lid protrusion part 222 is formed at another side surface of the second lid 22 which is opposite to the hinge part of the second lid 22; the brush assembly 24 comprised an assembly case 243, a brush fixture 241 adapted to allow a plurality of bristles 242 to be fastened thereto and movably formed within the brush case 243 and a brush fixture moving grip 244 integrally formed with the brush fixture 241 in such a manner as to be outwardly protruded through an opening formed at one portion of the brush case 243; a second bottom plate 23 is mounted on the bottom surface of the swab body insertion hole of the second container body 21 and having a brush assembly guide groove 233 for allowing the brush assembly 24 to be fixedly inserted thereinto, a second spring fixture for allowing the second spring 26 to be fixed thereto and second spring fixing projections 232; and a second spring 26 for elastically supporting the brush assembly 24 is disposed on the second bottom plate 23.

Figure 8:
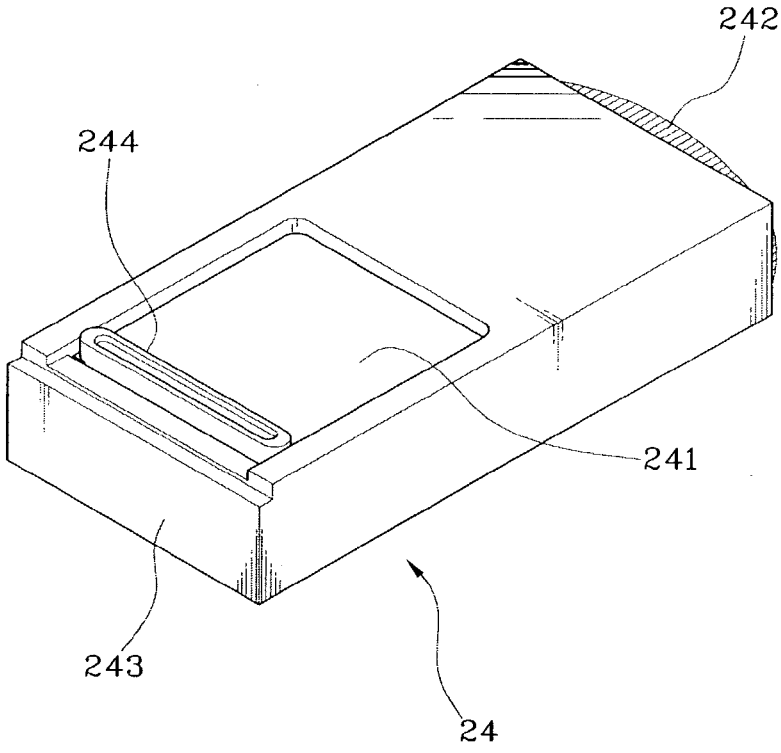
FIG. 8 is a perspective view illustrating a state in which a brush assembly used in the cosmetics container is drawn in according to the present invention.
Figure 9:
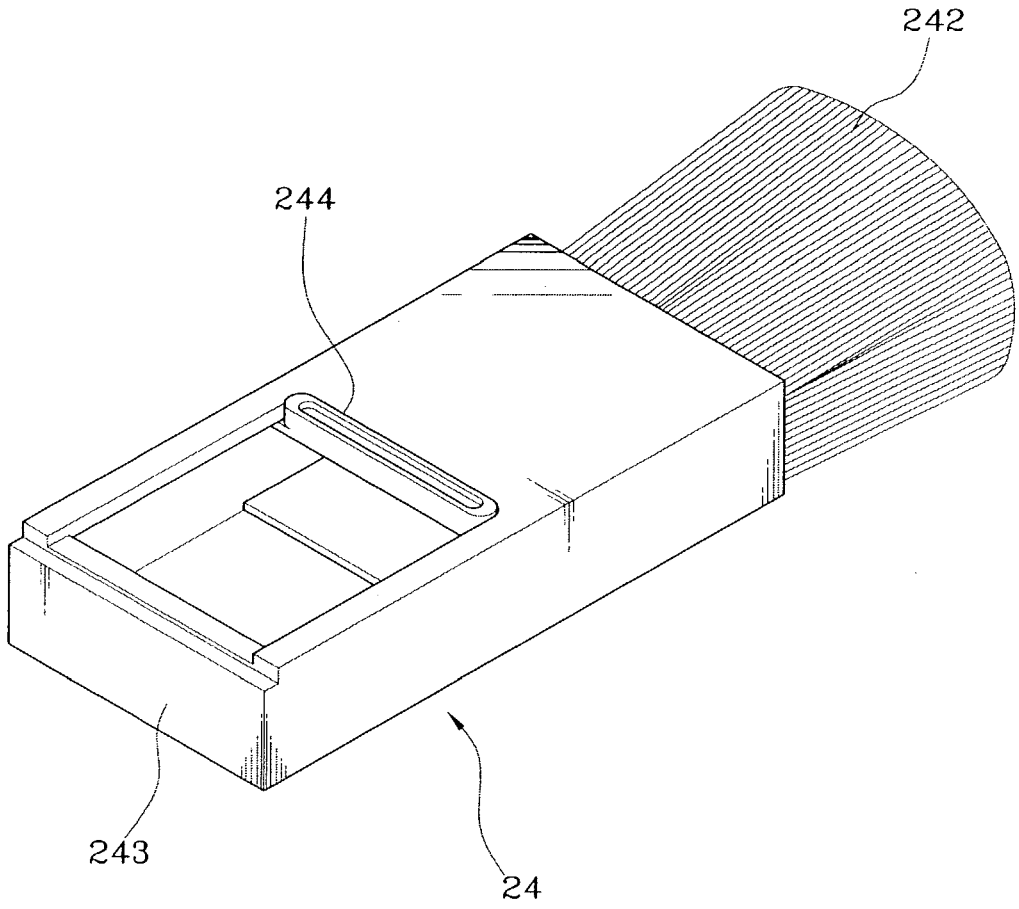
FIG. 9 is a perspective view illustrating a state in which the brush assembly of FIG. 8 is drawn out.

FIG. 8 is a perspective view illustrating a state in which the brush assembly 24 is drawn in according to the present invention, and FIG. 9 is a perspective view illustrating a state in which the brush assembly 24 of FIG. 8 is drawn out.

Figure 5:
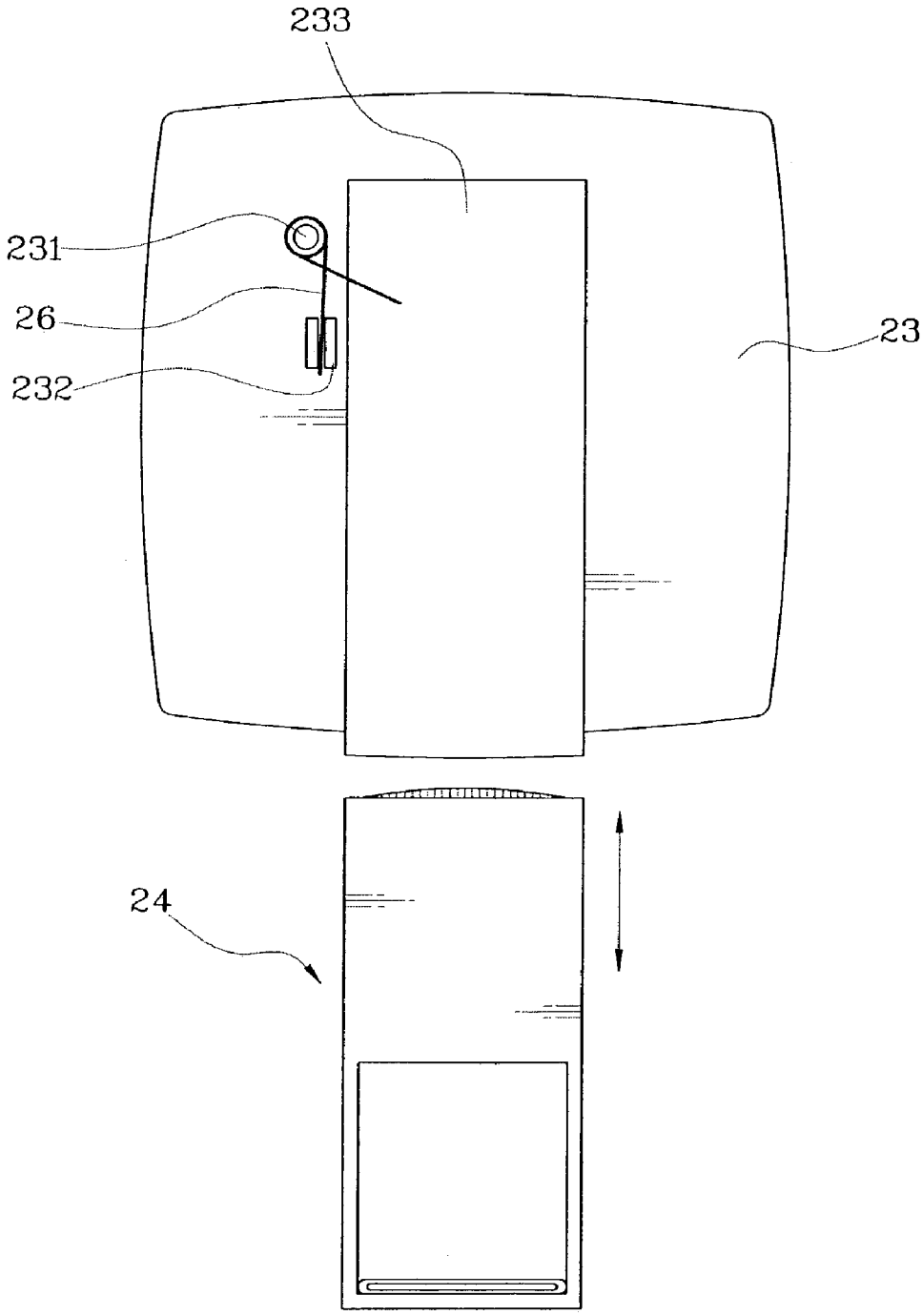
FIG. 5 is a top plan view illustrating a bottom plate of the cosmetics container of FIG. 4.
Figure 6:
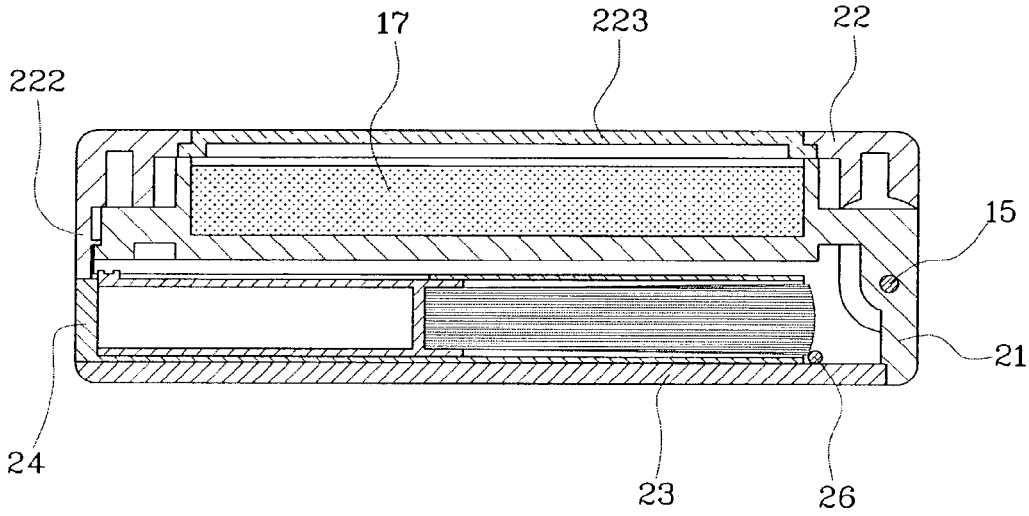
FIG. 6 is a side sectional view illustrating a state in which the cosmetics container of FIG. 4 is closed.
Figure 7:
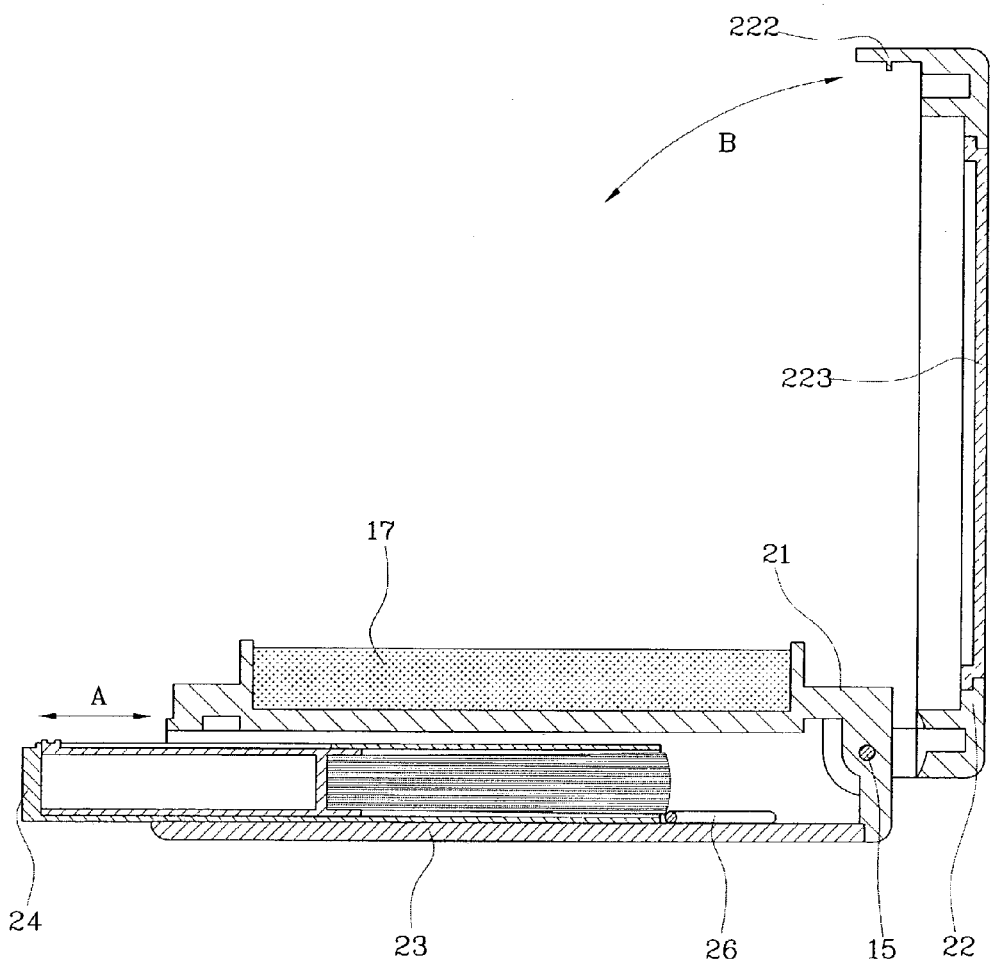
FIG. 7 is a side sectional view illustrating a state in which the cosmetics container of FIG. 4 is opened.

The cosmetics container of the second preferred embodiment is identical in basic structure to that of the first preferred embodiment. However, there is a slight difference between the two embodiments. That is, the positions and shapes of the first spring 16 and the second spring 26, the structures of the swab body 14 and the brush assembly 24 which is used instead of the swab body 14 and the position of the second spring 26 contacted are different therebetween. Such differences occur because the structures of the cosmetic implements are different and therefore, the positions and shapes of the springs 16 and 26 which elastically support the cosmetic implements are differentiated from each other. When the brush assembly 24 of FIGS. 8 and 9 is used as the cosmetic implement, instead of the swab body 14 of FIG. 1, the brush assembly 24 doesn't require the spring stopper 143 of the swab body 14. The brush assembly 24 can be elastically supported when the bottom surface of the brush case 243 of the brush assembly 24 is contacted by the second spring 26. As shown in FIG. 5, according to a difference in the contact position between the brush assembly 24 and the second spring 26, the second spring 26 is variably fixed to the second bottom plate 23. Further, the brush assembly guide groove 233 which has the same function as the swab body guide groove 132 is formed at the second bottom plate 23. However, since the brush assembly 24 doesn't adopt the spring stopper 143, there is no need of forming the spring stopper guide groove 133 at the bottom plate 13 of FIG. 1 for receiving and guiding the spring stopper 143. FIG. 6 is a side sectional view illustrating a state in which the cosmetics container of the second preferred embodiment of the present invention is closed. When the user holds the second lid 22 and the second container body 21 in his or her hand and lifts the lid 22 in an arrow direction B as shown in FIG. 7 in the same manner as that in the first preferred embodiment, the brush assembly 24 is drawn out in an arrow direction A. Accordingly, the user can use the brush assembly 24 as the cosmetic implement while holding the same. The second lid 22 may have a second transparent pane 223, which is identical or similar to the transparent pane 123, formed thereon. The second transparent pane 223 can take various shapes including a circular or quadrangular shape.

Figure 10:
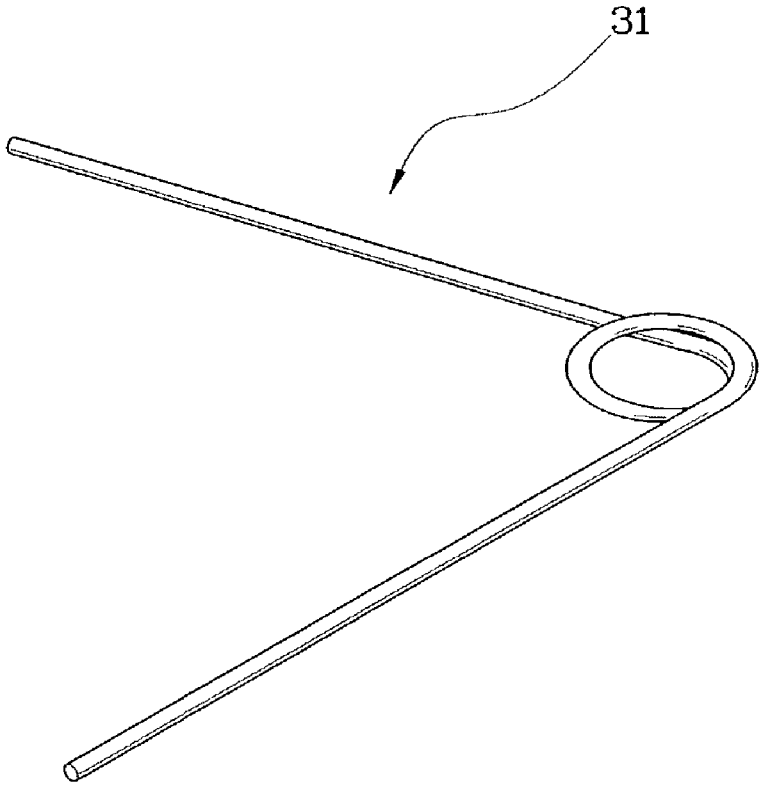
FIG. 10 is a perspective view illustrating another example of a spring used in the cosmetics container according to the present invention.

Furthermore, other cosmetic implements than the swab body 14 or the brush assembly 24 can be used in the cosmetics container. In this case, a different type of spring can be applied according to the contact condition between the used cosmetic implement and spring. For example, the second spring 26 fixed to the second bottom plate 23 shown in FIG. 5 can be replaced by a third spring 31 shown in FIG. 10.

Figure 11:
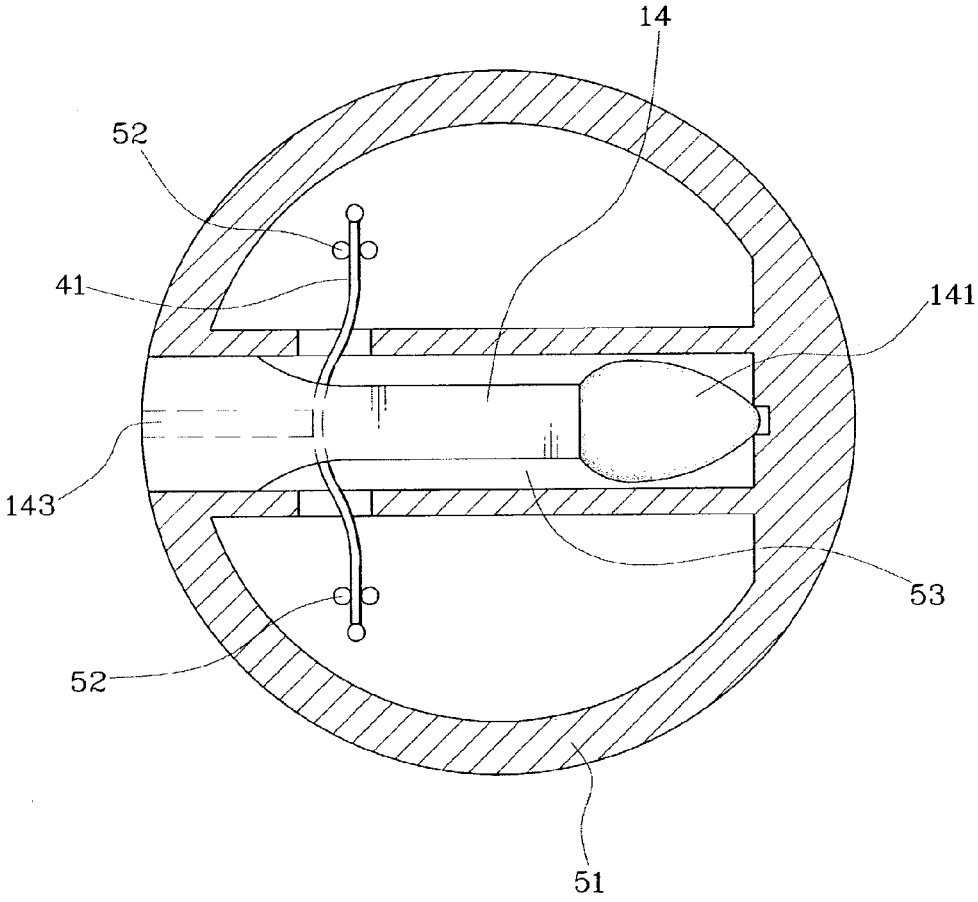
FIG. 11 is a top plan view illustrating still another example of a spring used in the cosmetics container according to the present invention.

Referring to FIG. 11, although the swab body 14 is used as the cosmetic implement, a different type of spring can be used along with a third bottom plate 51 which is used instead of the bottom plate 13. By way of example, a linear type of fourth spring 41 having a curved central portion can be used as shown in FIG. 11. In this case, the third bottom plate 51 has a plurality of fourth spring fixtures 52 formed thereon for fixing both sides of the fourth spring 41, and a second swab body guide groove 53 formed thereon for guiding and receiving the swab body 14.

Figure 14:
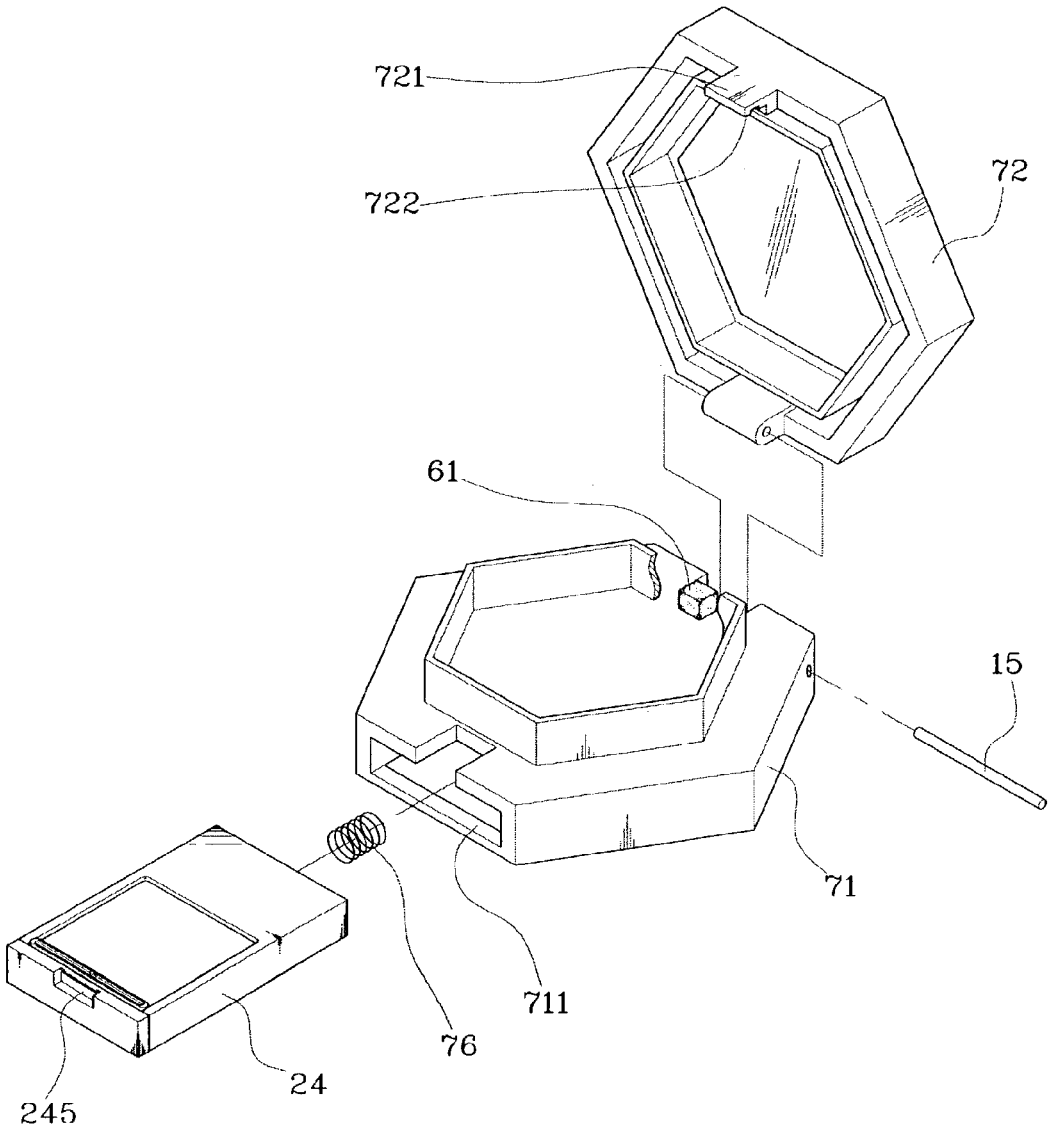
FIG. 14 is an exploded perspective view of a cosmetics container according a fourth preferred embodiment of the present invention.
Figure 15:
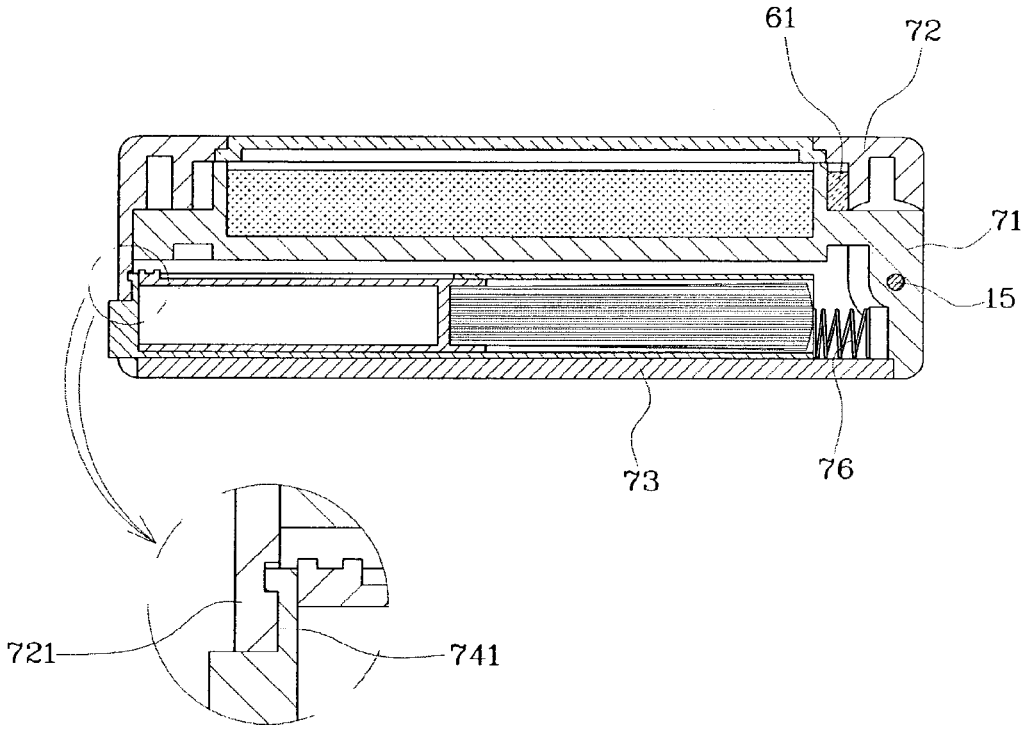
FIG. 15 is a side sectional view of the cosmetics container of FIG. 14.

Furthermore, as shown in FIGS. 14 and 15, in the event that the brush assembly 24 is used, a cylindrical fifth spring 76 can be used. The fifth spring 76 ensures to elastically support the brush assembly 24.

Referring to FIG. 14, the cosmetics container can take a regular hexagonal prism shape. In this case, a third lid 72 is hingeably connected to a third container body 71 by means of the hinge shaft 15. The third lid 72 has a lid protrusion part 721 at one side surface thereof, and a third bottom plate 73 is coupled to the bottom surface of the third container body 71. The third container body 71 has a brush assembly insertion groove 711 formed at one side surface thereof for allowing the brush assembly 24 to be inserted thereinto through the brush assembly insertion groove 711. The structure of this embodiment is identical or similar to that of the aforementioned preferred embodiments.

On the other hand, FIGS. 12 to 15 show that a projection and a recess are formed at the cosmetics container. To be specific, in FIGS. 12 and 13, the lid protrusion part 122 of the lid 12 includes a projection 124 integrally formed therewith in such a manner as to be extended inwardly therefrom and perpendicularly thereto and the swab body 14 includes a recess 144 formed at the outer surface of one end thereof in such a manner as to come in contact with the lid protrusion part 122 of the lid 12, whereas, in FIGS. 14 and 15, the lid protrusion part 721 includes a projection 741 integrally formed therewith in such a manner as to be extended inwardly therefrom and perpendicularly thereto and the brush assembly 24 includes a recess 245 formed at the outer surface of one end thereof in such a manner as to come in contact with the lid protrusion part 721 of the third lid 72. The recess 144 is available when the swab body 14 is used while the recess 245 is available when the brush assembly 24 is used. The recess 144 receives the projection 124 formed at the lid protrusion part 122 of the lid 12 while the recess 245 receives the projection 741 formed at the lid protrusion part 724 of the third lid 72, to certainly prevent the lid 12 and the third lid 72 from being unexpectedly opened, respectively. In those structures, for the purpose of firmly pressing the swab body 14 and exactly opening the lid 12 according to the user's intention, the swab body 14 further includes a press projection 145 formed at one end surface thereof in such a manner as to be outwardly extended therefrom.

Figure 12:
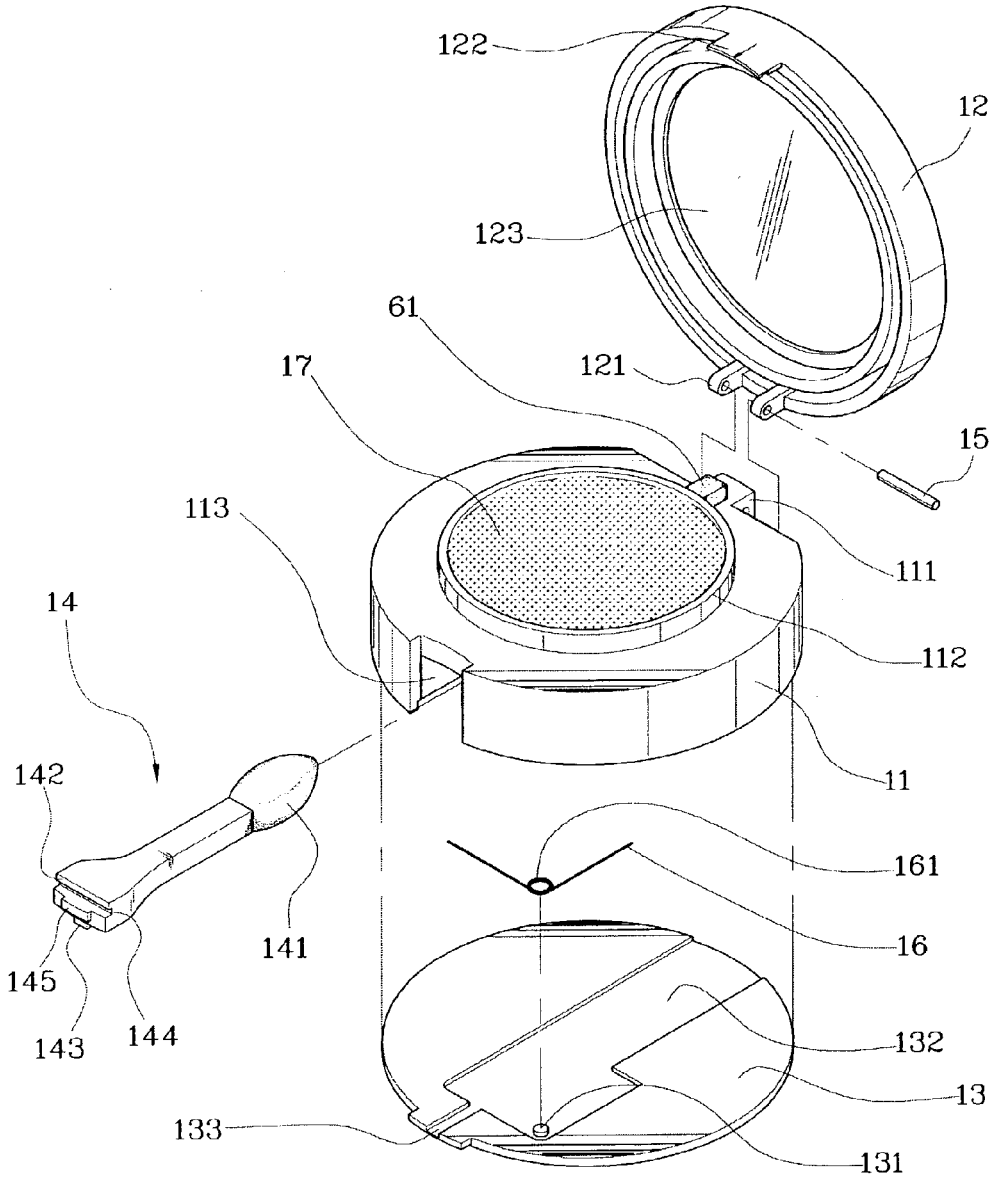
FIG. 12 is an exploded perspective view of a cosmetics container according to a third preferred embodiment of the present invention.
Figure 13:
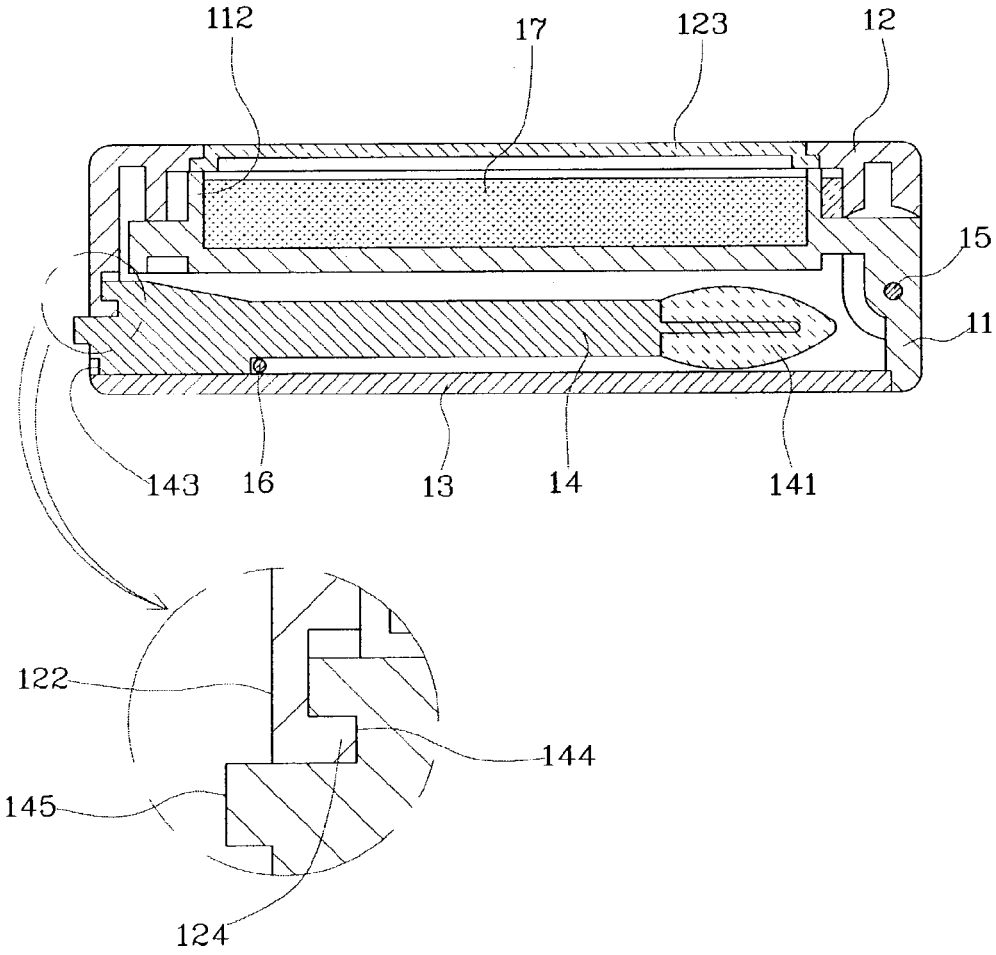
FIG. 13 is a side sectional view of the cosmetics container of FIG. 12.

Referring to FIGS. 12 and 13, an elastic body 61 may be interposed between the outer surface of a cosmetic composition receiving part 17 of the container body 11 and the inner surface of the lid 12. The elastic body 61 is made of rubber or other common elastic material. When the lid 12 is put on the container body 12 to be closed, the container body 12 is elastically supported by the elastic body 61. Therefore, when the user presses the press projection 145 of the swab body 14 formed in the container body 11, the recess 144 of the swab body 14 is moved inwardly in the container body 11 while the projection 124 formed at the lid protrusion part 122 of the lid 12 is kept in its place. As a result, the projection 124 is separated from the recess 144 and accordingly, the lid 12 is slightly lifted due to the elastic force of the elastic body 61, leading to an opened state of the cosmetics container.

The spring 16 for elastically supporting the cosmetic implement and the spring fixture 131 for fixing the spring 16 can be changed or modified in their shapes according to the shapes and dimensions of the cosmetic implements and the springs in contact with the cosmetic implements within the scope of the present invention.

Figure 16:
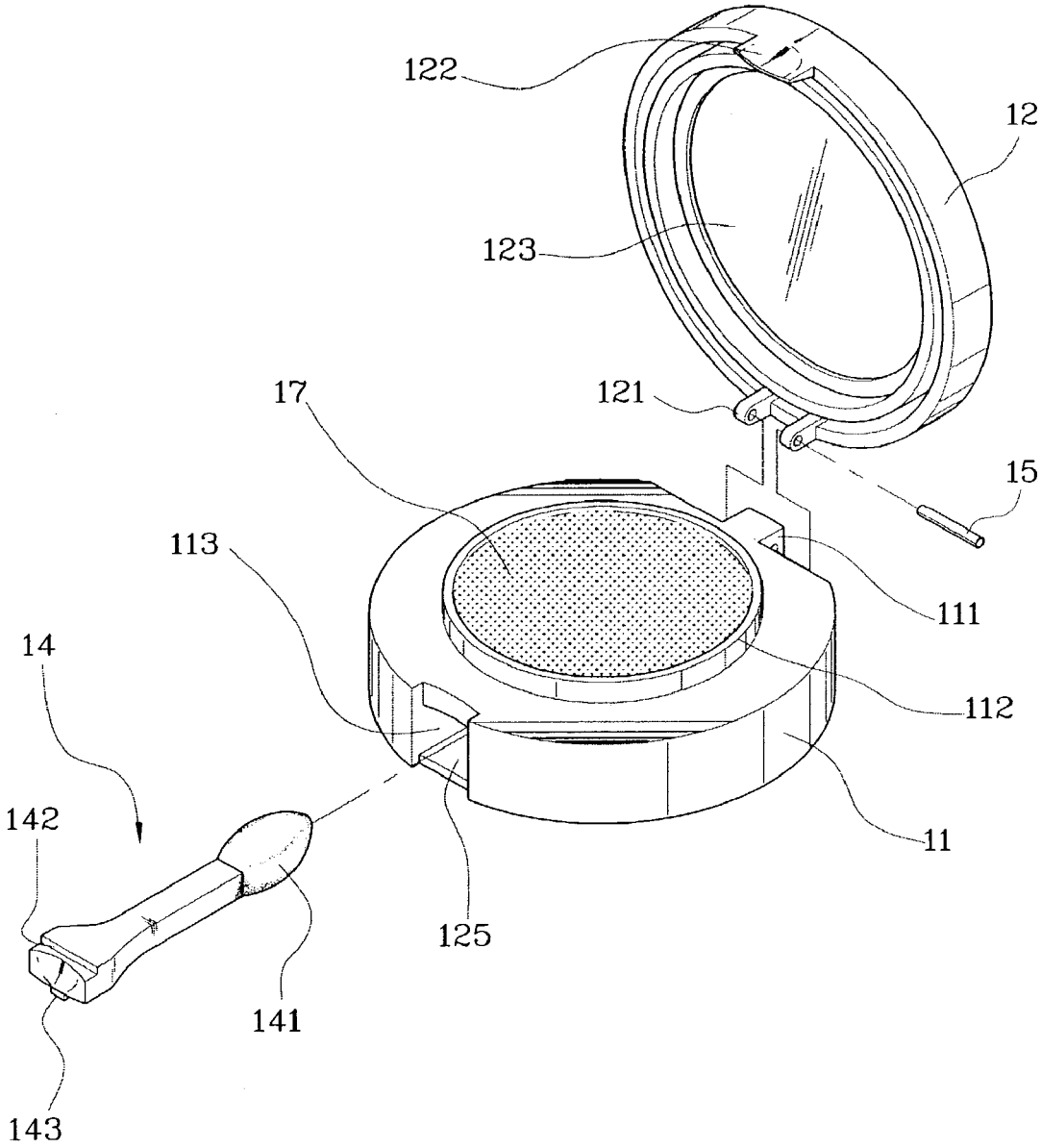
FIG. 16 is an exploded perspective view of a cosmetics container according to a fifth preferred embodiment of the present invention.

Referring to FIG. 16, the cosmetics container of the present invention may include no spring for pushing the swab body 14. Without any spring, the swab body 14 and the container body 12 can be fixed due to the friction between the lid contact part 142 of the swab body 14 and the inner surface of the lid protrusion part 122 of the lid 12. This embodiment can be achieved with the simple structure without any spring, resulting in improvement in productivity. This structure may not require the bottom plate in which the spring fixture is formed, but it includes a partial bottom plate 125 for closing only the bottom surface of the swab body insertion hole 113 through which the swab body is inserted into the container body 11.

Figure 17:
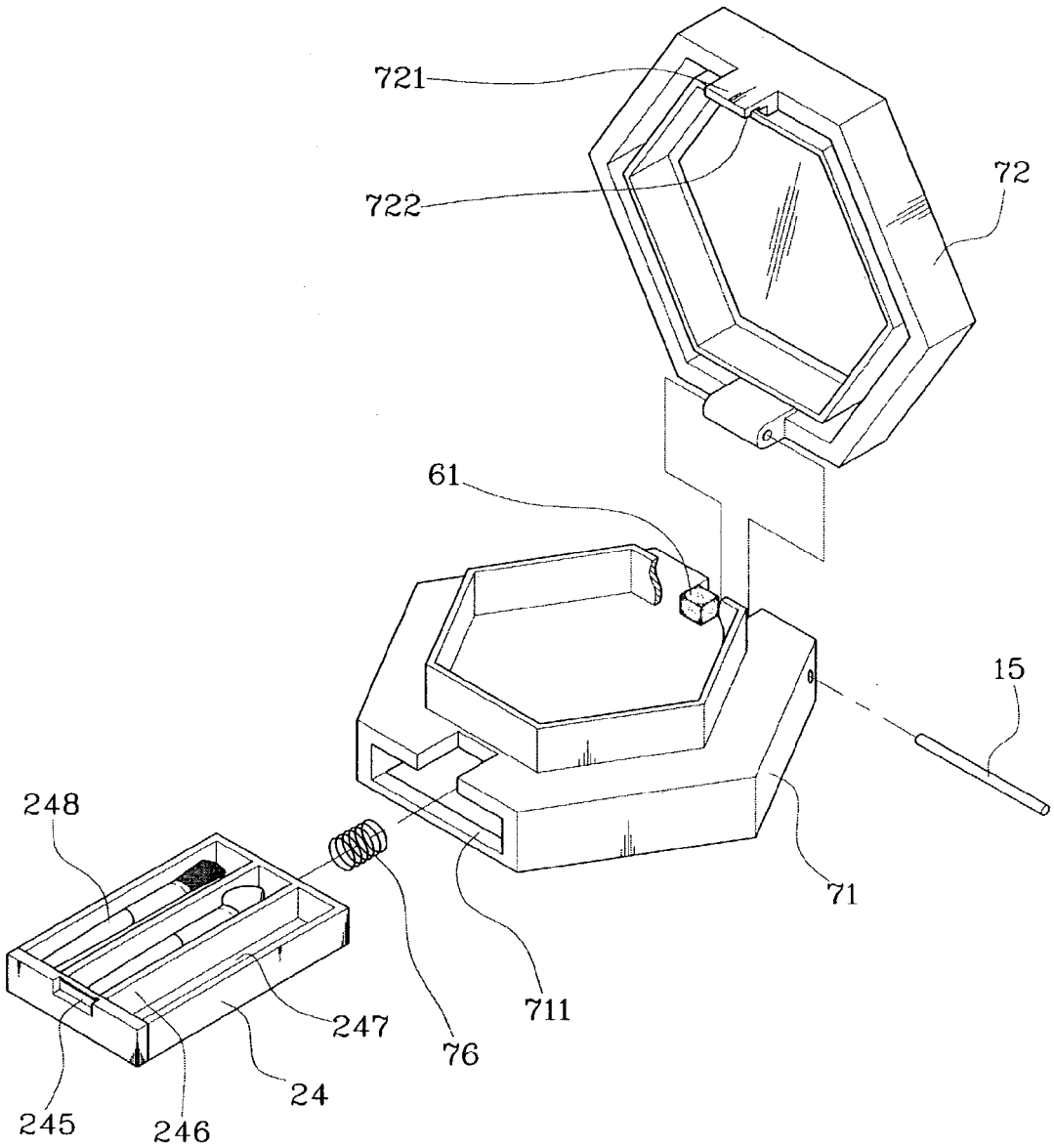
FIG. 17 is an exploded perspective view of a cosmetics container according to a sixth preferred embodiment of the present invention.

Referring to FIG. 17, the brush assembly 24 can be replaced by an implement case which has implement accommodation compartments 247 formed therein by dividing the inner space thereof into several parts by means of one or more partition walls 246 for receiving a plurality of cosmetic implements 248 therein. The implement case is similar in dimension and external appearance to the brush assembly 24 basically, but has a cubic shape with its top opened. The inner space of the implement case is divided into the several parts by the one or more partition walls 246 so that cosmetic implements having various shapes and dimensions can be received in the plurality of implement accommodation compartments 247, thereby giving a chance to the user to select a proper one according to his or her preference.

As described above, the cosmetics container of the present invention has an advantage in that the lid 12 for protecting the cosmetic compositions 17 contained in the container body 11 is stuck to the container body to be opened and closed by means of the brush assembly 24 or the swab body for use in applying cosmetics, the lid 12 is not unexpectedly opened due to the contact between the cosmetic implement which is elastically supported by the spring 16 and the lid protrusion part 122 of the lid 12, the cosmetic implement held in the container body 11 is automatically drawn out by opening the lid 12 to achieve convenience in use, the cosmetic container has an aesthetically pleasing appearance and a sufficient amount of cosmetic compositions can be contained in the container body 11.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A cosmetics container comprising:

a container body adapted to contain cosmetic compositions therein, a lid having a hinge part formed at one side surface thereof for hingeably connecting the lid to the container body and a swab body adapted to act as a cosmetic implement, a swab body insertion hole is formed at one side surface of the container body which is opposite to the hinge part of the lid;

a lid protrusion part is formed at another side surface of the lid which is opposite to the hinge part of the lid;

the swab body comprises a swab part formed at one end thereof for applying cosmetics, a lid contact part formed at the top portion of another end thereof opposite to the swab part and a spring stopper formed at the bottom of the another end thereof, a bottom plate is mounted on the bottom surface of the container body and includes a swab body guide groove formed thereon for allowing the swab body to be fixedly inserted thereinto, a spring stopper guide groove formed thereon for allowing the spring stopper of the swab body to be fixedly inserted thereinto and a spring fixture formed thereon for allowing the spring to be fixed thereto; and a spring for elastically supporting the swab body is disposed on the bottom plate.

2. The cosmetics container of claim 1, wherein the cosmetics container has a shape chosen from the group consisting of: cylindrical shape, hexagonal prism shape or polygonal prism.

3. The cosmetics container of claim 1, wherein the swab body is a brush assembly.

4. The cosmetics container of claim 3, wherein the brush assembly includes an assembly case, a brush fixture adapted to allow a plurality of bristles to be fastened thereto and movably formed within the brush case and a brush fixture moving grip integrally formed with the brush fixture in such a manner as to be outwardly protruded through an opening formed at one portion of the brush case.

5. The cosmetics container of claim 1, wherein the lid protrusion part of the lid includes a projection integrally formed therewith in such a manner as to be extended inwardly therefrom and perpendicularly thereto, and the swab body has a recess formed at the outer surface of one end thereof in such a manner as to come in contact with the lid protrusion part of the lid.

6. The cosmetics container of claim 1, further comprising an elastic body formed between the outer surface of a cosmetic composition receiving part of the container body and the inner surface of the lid.

7. The cosmetics container of claim 3, wherein the brush assembly includes an implement case which has implement accommodation compartments formed therein by dividing the inner space thereof into several parts by means of one or more partition walls for receiving a plurality of cosmetic implements therein.

8. A cosmetics container comprising:

A container body adapted to contain cosmetic compositions therein, a lid having a hinge part formed at one side surface thereof for hingeably connecting the lid to the container body and a brush assembly as a cosmetic implement, a swab body insertion hole is formed at one side surface of the container body which is opposite to the hinge part of the lid; a lid protrusion part is formed at another side surface of the lid which is opposite to the hinge part of the lid; the brush assembly comprises an assembly case, a brush fixture adapted to allow a plurality of bristles to be fastened thereto and movably formed within the brush case and a brush fixture moving grip integrally formed with the brush fixture in such a manner as to be outwardly protruded through an opening formed at one potion of the brush case; a bottom plate is mounted on the bottom surface of the swab body insertion hole of the container body and includes a brush assembly guide groove for allowing the brush assembly to be fixedly inserted thereinto, a spring fixture for allowing a spring to be fixed thereto and spring fixing projections; and a spring for elastically supporting the brush assembly is disposed on the bottom plate.

9. The cosmetics container of claim 8, wherein the brush assembly including an implement case having implement accommodation compartments formed therein by dividing the inner space thereof into several parts by means of one or more partition walls for receiving a plurality of cosmetic implements therein.

10. The cosmetics container of claim 8, wherein the cosmetics container has a shape chosen from the group consisting of: cylindrical shape, hexagonal prism shape or polygonal prism.

11. A cosmetics container comprising:

a container body for containing cosmetic compositions comprising a lid having a hinge part, a swab body, a swab body insertion hole located at a side surface of the container body which is opposite to the hinge part of the lid;

a lid protrusion part located at a side surface of the lid which is opposite to the hinge part of the lid;

the swab body comprises at one end thereof a swab part, a lid contact part formed at the top portion of another end thereof opposite to the swab part and a spring stopper formed at a bottom of the another end thereof, a bottom plate is mounted on a bottom surface of the container body and includes a guide groove that is so constructed and arranged that the swab body can be inserted thereinto, a second guide groove formed thereon that is so constructed and arranged that the spring stopper of the swab body can be inserted thereinto and a spring fixture formed thereon that is so constructed and arranged that the spring can be fixed thereto; and a spring for elastically supporting the swab body is disposed on the bottom plate.

12. The cosmetics container of claim 11, wherein the container has a shape chosen from the group consisting of: cylindrical shape, hexagonal prism shape or polygonal prism.

13. The cosmetics container of claim 11, wherein the swab body is a brush assembly.

14. The cosmetics container of claim 13, wherein the brush assembly includes an assembly case, a brush fixture adapted to allow a plurality of bristles to be fastened thereto and movably formed within the brush case and a brush fixture moving grip integrally formed with the brush fixture in such a manner as to be outwardly protruded through an opening formed at one portion of the brush case.

15. The cosmetics container of claim 11, wherein the lid protrusion part of the lid includes a projection integrally formed therewith in such a manner as to be extended inwardly therefrom and perpendicularly thereto, and the swab body has a recess formed at the outer surface of one end thereof in such a manner as to come in contact with the lid protrusion part of the lid.

16. The cosmetics container of claim 11, further comprising an elastic body formed between the outer surface of a cosmetic composition receiving part of the container body and the inner surface of the lid.

17. The cosmetics container of claim 13, wherein the brush assembly includes an implement case which has implement accommodation compartments formed therein by dividing the inner space thereof into several parts by means of one or more partition walls for receiving a plurality of cosmetic implements therein.

* * * * *